US006829979B1

(12) United States Patent
Thomas

(10) Patent No.: US 6,829,979 B1
(45) Date of Patent: Dec. 14, 2004

(54) SWASHPLATE HOLDDOWN AND ADJUSTABLE CENTERING MECHANISM

(75) Inventor: Sutanto Thomas, Eden Prairie, MN (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 10/627,122

(22) Filed: Jul. 24, 2003

(51) Int. Cl.[7] ..... F01B 3/02
(52) U.S. Cl. ..... 92/12.2
(58) Field of Search ..... 74/839; 91/505; 92/12.2

(56) References Cited

U.S. PATENT DOCUMENTS

| | | | | |
|---|---|---|---|---|
| 4,283,962 A | * | 8/1981 | Forster | 91/505 |
| 4,584,926 A | | 4/1986 | Beck, Jr. et al. | 92/12.2 |
| 4,955,249 A | * | 9/1990 | Wetor | 74/96 |
| 5,207,144 A | | 5/1993 | Sporrer et al. | 92/12.2 |
| 6,701,825 B1 | * | 3/2004 | Langenfeld | 92/12.2 |

* cited by examiner

*Primary Examiner*—F. Daniel Lopez
(74) *Attorney, Agent, or Firm*—L. J. Kasper

(57) ABSTRACT

A swashplate centering and holddown mechanism (55) for an axial piston unit (11) comprising a cylinder barrel (29) disposed for rotation about an axis of rotation (A). A cam member (39) is tiltable about a transverse axis and has a swashplate (37). The swashplate (37) is perpendicular to the axis of rotation (A), in a neutral position, and has a displaced position (FIG. 4). The swashplate centering and holddown mechanism biases the cam member (39) axially toward a cradle surface (41) and pivotably toward the neutral position (FIG. 3). The mechanism (55) comprises a pair of arms (67,69), each of which defines a pivot location (71,73), at one axial end thereof, fixed relative to a pump housing (19) on one side of the axis of rotation (A), and a swashplate-engaging portion (95,97), at the opposite axial end thereof, engaging the swashplate, on the other side of said axis of rotation (A), when said swashplate is in neutral. A connector (79) is operably associated with the arms (67,69), whereby the arms are able to pivot about the pivot locations (71,73) in a generally scissors-type movement. A pair of springs (63,65) biases the swashplate-engaging portions of the arms toward the swashplate (37), whereby, in the absence of an input to tilt the cam member (39), the swashplate is in engagement with both of said swashplate-engaging portions (95,97) and is in the neutral position (FIG. 3).

6 Claims, 8 Drawing Sheets

SWASHPLATE HOLDDOWN AND ADJUSTABLE CENTERING MECHANISM

BACKGROUND OF THE DISCLOSURE

The present invention relates to variable displacement hydraulic pumps of the type having a rotating group and a tiltable cam member and swashplate for varying the displacement of the rotating group, and more particularly, to a swashplate centering and holddown mechanism for such pumps. Even more particularly, the present invention relates to such a mechanism in which the centering portion of the mechanism is adjustable.

Although the hydraulic pump, of the type with which the present invention may be utilized, may include various types of rotating groups, the invention is especially advantageous when used with a pump rotating group of the "in-line" axial piston type, i.e., one which includes a rotating cylinder barrel defining a plurality of cylinders, and a piston reciprocable within each cylinder, wherein the cylinders are parallel to each other and to the axis of rotation of an input shaft. Therefore, the present invention will be described in connection with such an in-line, axial piston pump.

Although the present invention may be used with various types of swashplate arrangements, it is greatly preferred that the invention be utilized in pumps of the "swash-and-cradle" type, as illustrated and described in U.S. Pat. No. 6,068,451, assigned to the assignee of the present invention and incorporated herein by reference. Therefore, the present invention will be illustrated and described in connection with an axial piston pump having a swash-and-cradle type of swashplate.

Changes in the displacement of an axial piston pump (by changing the tilt angle of the swashplate) may be accomplished either by an appropriate hydraulic servo mechanism, or by some sort of manual input. In the past, it was conventional practice that, if the displacement changes were to be accomplished by means of a hydraulic servo mechanism, the servo mechanism itself would include an appropriate centering device, i.e., a device which biases the servo, and indirectly, the swashplate also, toward its neutral (zero displacement) position. More recently, however, it has become more common to omit from the hydraulic servo mechanism the centering device (springs), and instead, locate within the pumping chamber a swashplate centering and holddown mechanism. Unlike the centering mechanism associated with the servo mechanism, the swashplate centering and holddown mechanism would accomplish both a centering function (zero displacement of the swashplate) and also a "holddown" function, by means of which the swashplate would be biased toward, and retained against, its adjacent cradle (bearing) surface.

Various centering and holddown devices have been designed by those skilled in the art, but, unfortunately, many of the prior art centering and holddown devices have been complicated and expensive, or have been difficult to assemble or adjust for neutral, or have involved some other operational disadvantage, such as imposing an undesirable side-load on the biasing springs.

An example of such a prior art centering and holddown mechanism, and one which is still in widespread commercial use, is shown in U.S. Pat. No. 4,584,926. In the device of the '926 patent, the adjustment of the centering mechanism is accomplished, at the time of pump assembly, by rotatably adjusting a relatively large, externally-threaded plate member which is received within a set of internal threads defined by the pump housing. The internal and external threads defined by the housing and the plate, respectively, add substantially to the overall machining and manufacturing cost of the pump. In addition, it has been observed that the rotatable plate, being held in place relative to the pump housing only by means of the threaded connection, can serve as a source of resonant noise and, under the right conditions, can actually amplify whatever noise is generated.

It has also been observed in connection with the mechanism of the '926 patent that, once the device is adjusted to achieve absolute neutral (zero displacement), the spring seat may no longer be perfectly perpendicular to the axis of rotation of the pump. Those skilled in the art will understand that the lack of perfect perpendicularity of the spring seat can impose a side load on the biasing springs of the mechanism which can reduce the life of the springs. Those skilled in the art will understand also that the performance of the mechanism of the '926 patent is very much dependent upon maintaining extremely close tolerances between the various points of mechanical connection within the mechanism, as well as between the mechanism and the pump housing.

BRIEF SUMMARY OF THE INVENTION

Accordingly, it is an object of the present invention to provide an improved swashplate centering and holddown mechanism of the type in which adjusting the mechanism for absolute neutral (zero pump displacement) does not introduce any other disadvantages in the pump operation, such as vibration and noise, or a side load imposed on the biasing springs.

It is another object of the present invention to provide such an improved swashplate centering and holddown mechanism, which achieves the above-stated object, and in which it is possible to utilize relatively looser manufacturing and assembly tolerances among the various parts without losing the ability to consistently achieve substantially absolute neutral (zero pump displacement).

The above and other objects of the invention are accomplished by the provision of an improved swashplate centering and holddown mechanism for a variable displacement axial piston unit comprising a housing defining a chamber, and an axis of rotation, a cylinder barrel disposed for rotation about the axis of rotation, the cylinder barrel defining a plurality of bores and having a plurality of pistons axially moveable therein. The unit includes a cam member tiltable about a transverse axis, perpendicular to the axis of rotation, and having a swashplate operably associated with each of the pistons to cause reciprocal movement thereof in response to rotation of the cylinder barrel, when the cam member is displaced from a neutral position, in which the swashplate is perpendicular to the axis of rotation, to a displaced position. The swashplate centering and holddown mechanism biases the cam member axially toward a cradle surface and pivotably toward the neutral position.

The improved mechanism is characterized by a pair of arms, each of the arms defining a pivot location, at one axial end thereof, fixed relative to the housing on one side of the axis of rotation, and a swashplate-engaging portion, at the opposite axial end thereof, engaging the swashplate, on the other side of the axis of rotation, when the swashplate is in the neutral position. A connector is operably associated with the arms, whereby the arms are able to pivot about the pivot locations in a generally scissors-type movement. A biasing means biases the swashplate-engaging portions of the arms towards the swashplate, whereby, in the absence of an input to tilt the cam member, the swashplate is in engagement with both of the swashplate-engaging portions and is in the neutral position.

DETAILED DESCRIPTION OF THE PREFERRED EMBODIMENT

Figure 1:
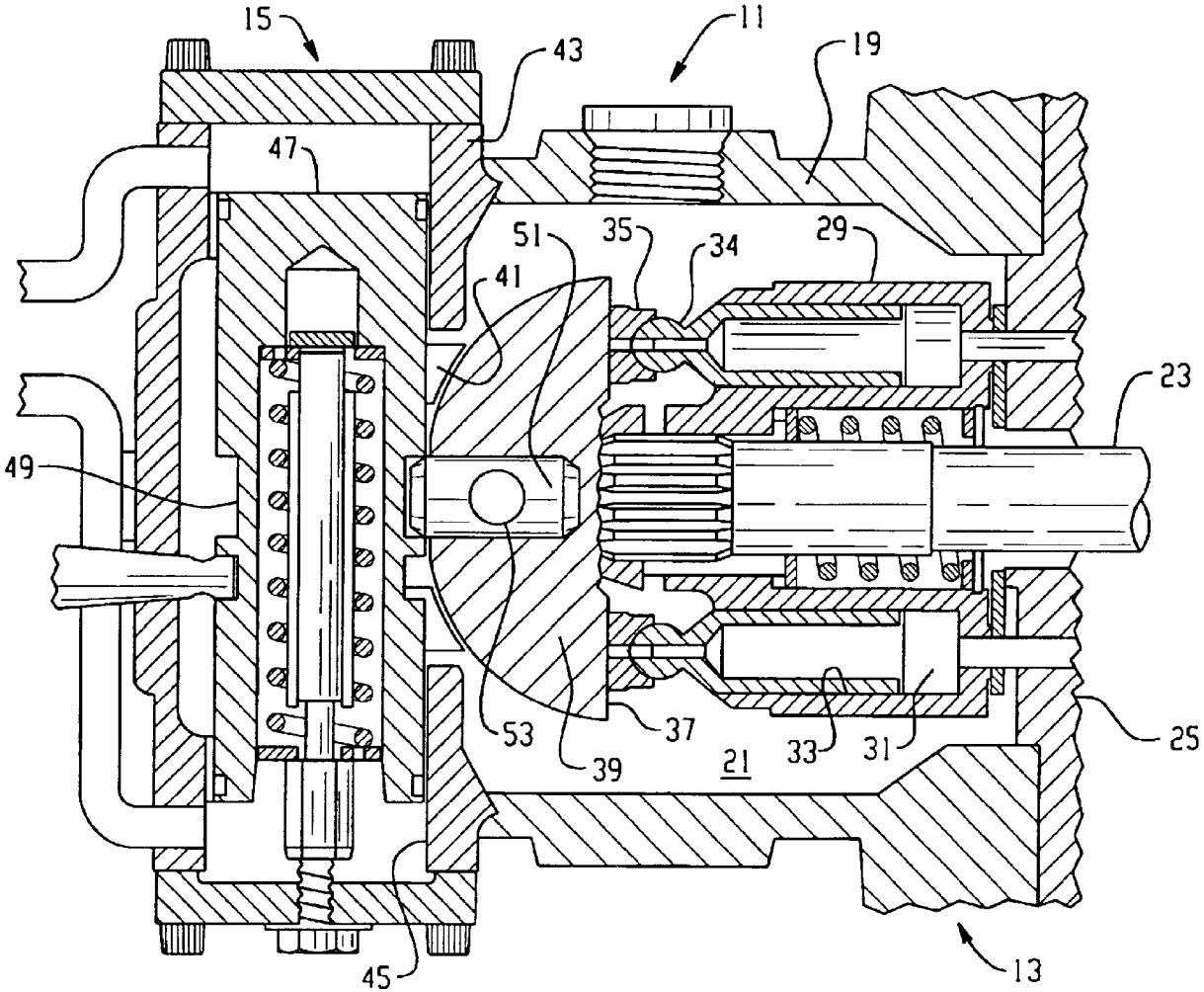
FIG. 1 is a somewhat schematic, fragmentary, axial cross-section of an in-line, variable displacement, axial piston pump of the type to which the present invention may advantageously be applied.

Referring now to the drawings, which are not intended to limit the invention, FIG. 1 illustrates a variable displacement axial piston pump, generally designated 11, of a type with which the present invention may be utilized. The pump 11 comprises two main portions: a pumping element 13 and a fluid pressure actuated servo assembly 15. It should be understood that the present invention does not require the specific type of pumping element 13 shown herein nor does it require a fluid pressure type of servo assembly for actuation of the pump 11.

The pumping element 13 includes a pump housing 19 which defines an internal cavity or chamber 21. An input shaft 23 extends into the cavity 21 from the left end in FIG. 1 (see FIG. 2) and then extends to the right through an opening in a port housing 25, as is well known to those skilled in the art. The port housing 25 is also sometimes referred to as a back-plate or as an endcap. As is used sometimes hereinafter, and in the appended claims, the term "housing" may mean and include both the pump housing 19 and the port housing 25, or either one individually, in view of the fact that the pump housing 19 and the port housing 25 cooperate to define the internal cavity 21.

Disposed about the input shaft 23, within the internal cavity 21, is a cylinder barrel 29, which is splined to the input shaft 23 to rotate therewith. The rotatable cylinder barrel 29 defines a plurality of cylinder bores 31, and disposed for reciprocating movement within each bore 31 is a piston 33. Each piston 33 includes a generally spherical head 34 which is received within a piston shoe 35 (also sometimes referred to as a "slipper"). The piston shoes 35 are retained in contact with a swashplate 37 in a manner generally well known to those skilled in the art. The term "swashplate 37" refers primarily to the planar surface of a cam member 39, the swashplate 37 comprising the surface with which the piston shoes 35 are engaged. Typically, the cam member 39 is mounted in a cam support or "cradle" 41, and is typically supported therein by suitable bearings (no reference numeral herein), as is common in the pump art.

In FIG. 1, the cam member 39 and swashplate 37 are shown in the neutral position, and movement of the cam member 39 from the neutral position in either direction will result in the stroke of the pistons 33 being changed in such a way that rotation of the cylinder barrel 29 will cause an output flow of pressurized fluid from the pumping element 13. During the operation of the pump, with the swashplate 37 tilted somewhat, the housing 19 and the cylinders 31 cooperate to define a pair of pressure fluid paths, one on the suction (inlet) side of the pump, and the other on the discharge (outlet) side of the pump.

The fluid pressure actuated servo assembly 15 comprises, in the subject embodiment, and by way of example only, a separate servo housing 43 suitably attached to the pump housing 19. The servo housing 43 defines a servo cylinder 45, and axially displaceable therein is a servo piston 47, which is shown in its neutral position in FIG. 1, corresponding to the neutral position of the swashplate 37. The servo piston 47 defines an annular groove 49, which receives the forward end of a servo piston follower 51. The follower 51 is attached to the cam member 39 by means of a follower pin 53, which is offset from the axis of pivotal movement of the cam member 39. As a result, movement of the servo piston 47 in a downward direction in FIG. 1 will move the servo piston follower 51 downward, causing the cam member 39 to pivot in a counterclockwise direction (about a transverse "axis", not shown herein, which is perpendicular to the axis of rotation of the input shaft 23) from the neutral position in FIG. 1 to a displaced or "operating" position. A further understanding of the structure and operation of the pump 11, and especially of the servo assembly 15, can be gained from a reading and understanding of above-incorporated U.S. Pat. No. 6,068,451.

Figure 2:
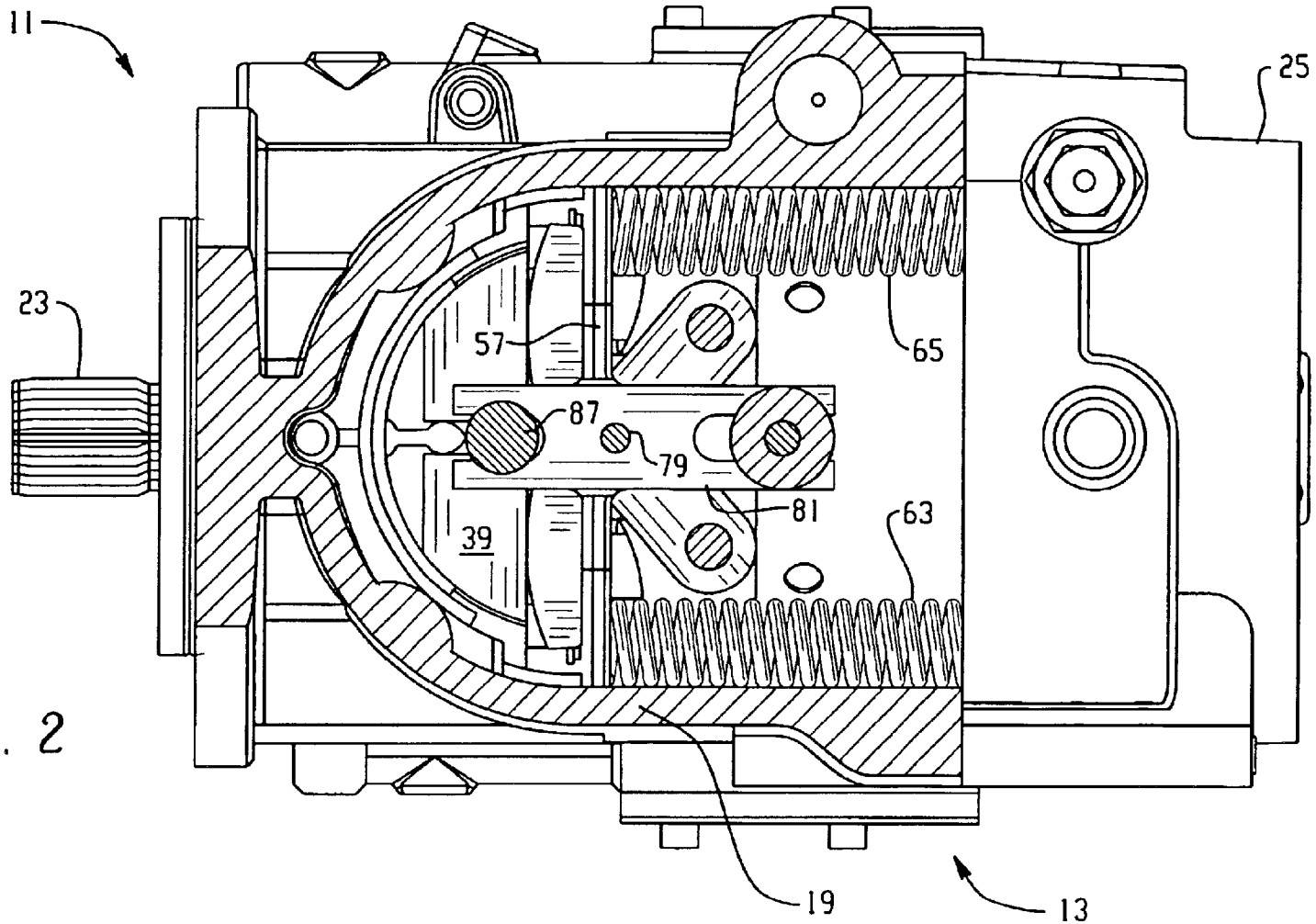
FIG. 2 is an axial cross-section, partly broken away and partly in external plan view, illustrating an axial piston pump, of the general type shown somewhat schematically in FIG. 1, including the swashplate centering and holddown mechanism of the present invention.

Referring now to FIG. 2, in conjunction with FIG. 3, the swashplate centering and holddown mechanism of the present invention, which is generally designated 55, will be described, it being understood that the view of FIG. 2 is included primarily to facilitate an understanding of the general location and spatial relationship of the mechanism 55, relative to the remainder of the axial piston pump 11. The mechanism 55 includes a spring seat bar 57 (see also FIGS. 2 and 7), which includes a pair of spring seats 59 and 61, preferably formed integrally therewith. In engagement with the spring seat 59 is a compression spring 63, and in engagement with the spring seat 61 is a compression spring 65. Preferably, the compression springs 63 and 65 are substantially identical in all characteristics such as overall length (in the relaxed state), diameter, spring rate, etc. As may best be seen in FIG. 2, the ends of the springs 63 and 65, opposite the spring seat bar 57 and the spring seats 59 and 61, are seated against an end wall of the chamber 21, formed, in the subject embodiment, by the port housing 25.

The mechanism 55 includes a pair of leveling arms 67 and 69. The leveling arm 67 has a holding pin 71 extending through an "upper" end (in FIG. 3) of the arm 67, and the holding pin 71 is fixed relative to the pump housing 19, such that the leveling arm 67 can pivot about the holding pin 71, relative to the housing 19. Similarly, the leveling arm 69 has a holding pin 73 extending through an upper end of the arm 69, and the holding pin 73 is fixed relative to the pump housing 19, such that the leveling arm 69 can pivot about the holding pin 73, relative to the housing 19.

Figure 3:
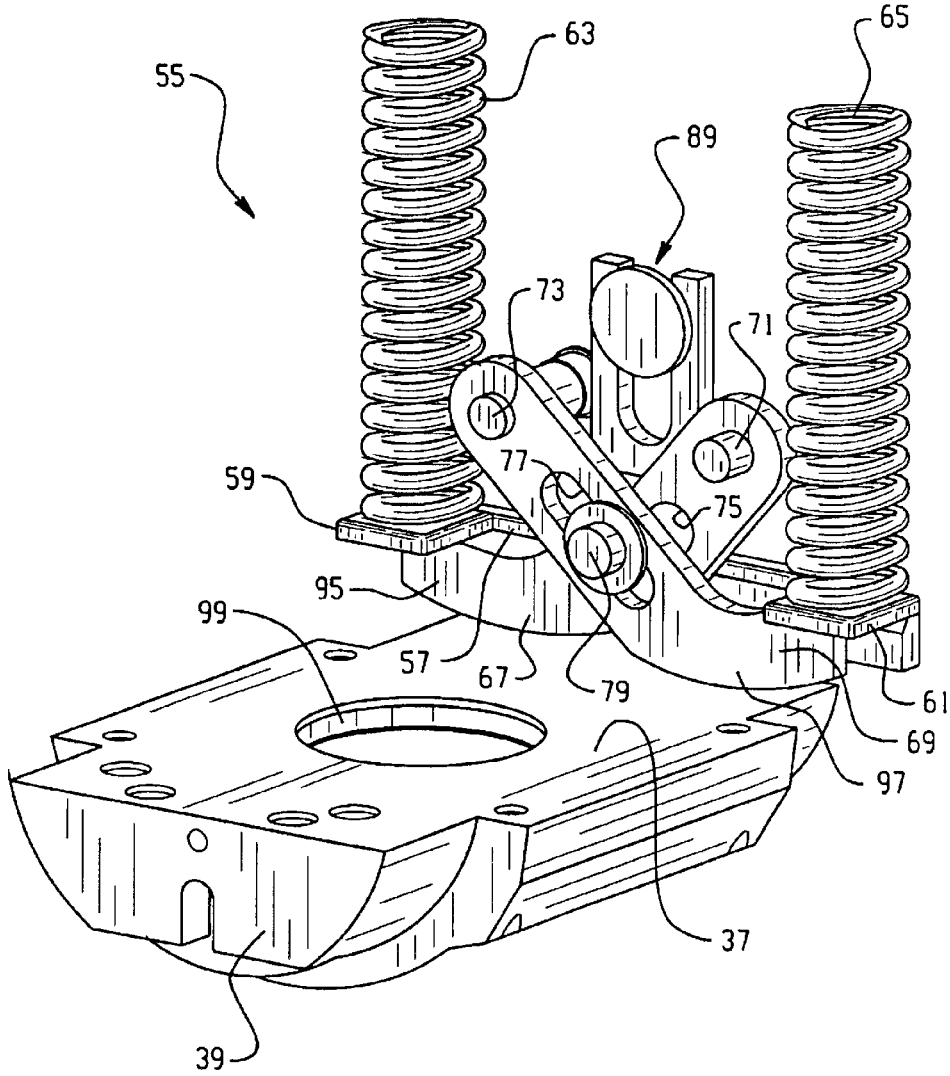
FIG. 3 is a somewhat enlarged, perspective view of the centering and holddown mechanism of the present invention, with the swashplate in its neutral position.
Figure 4:
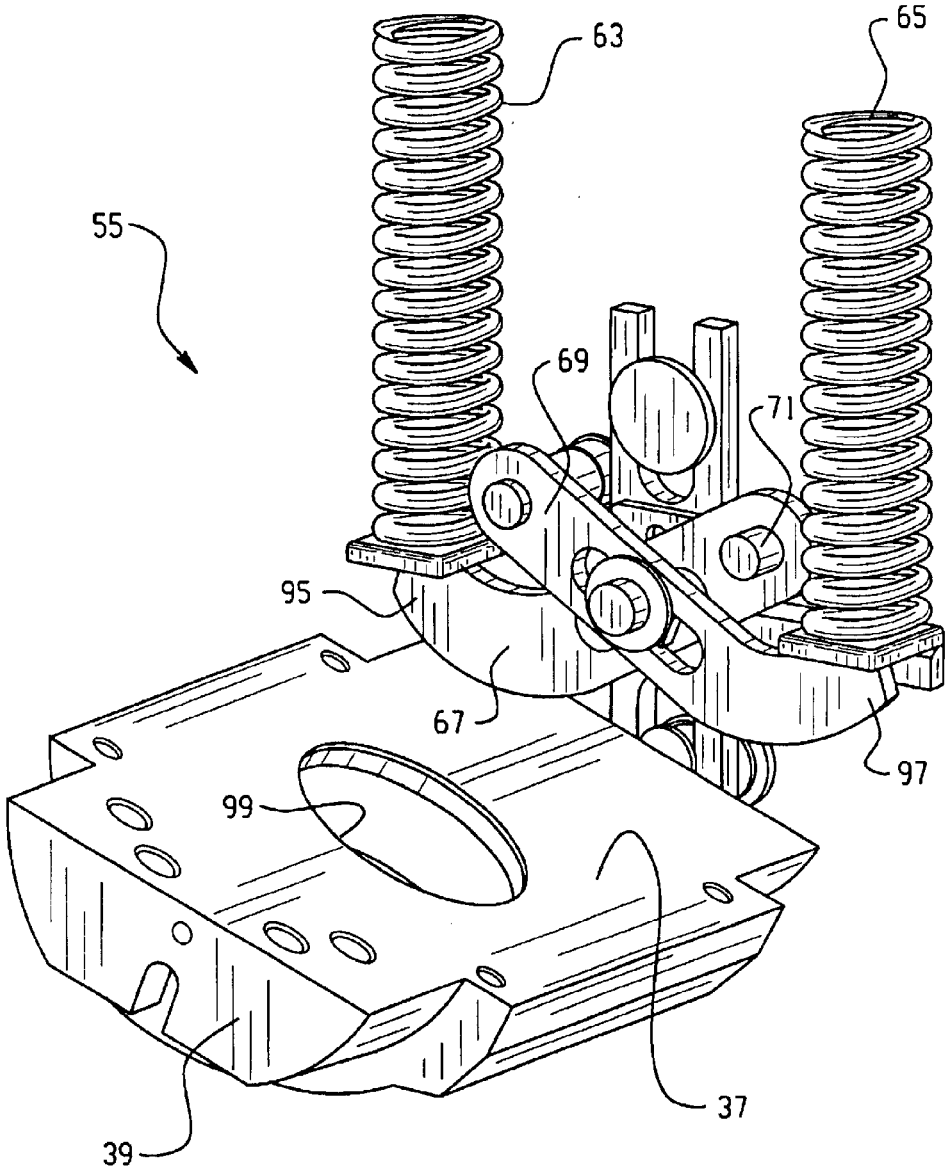
FIG. 4 is a perspective view, similar to FIG. 3, but with the swashplate tilted from its neutral position to a displaced, operating position.
Figure 5:
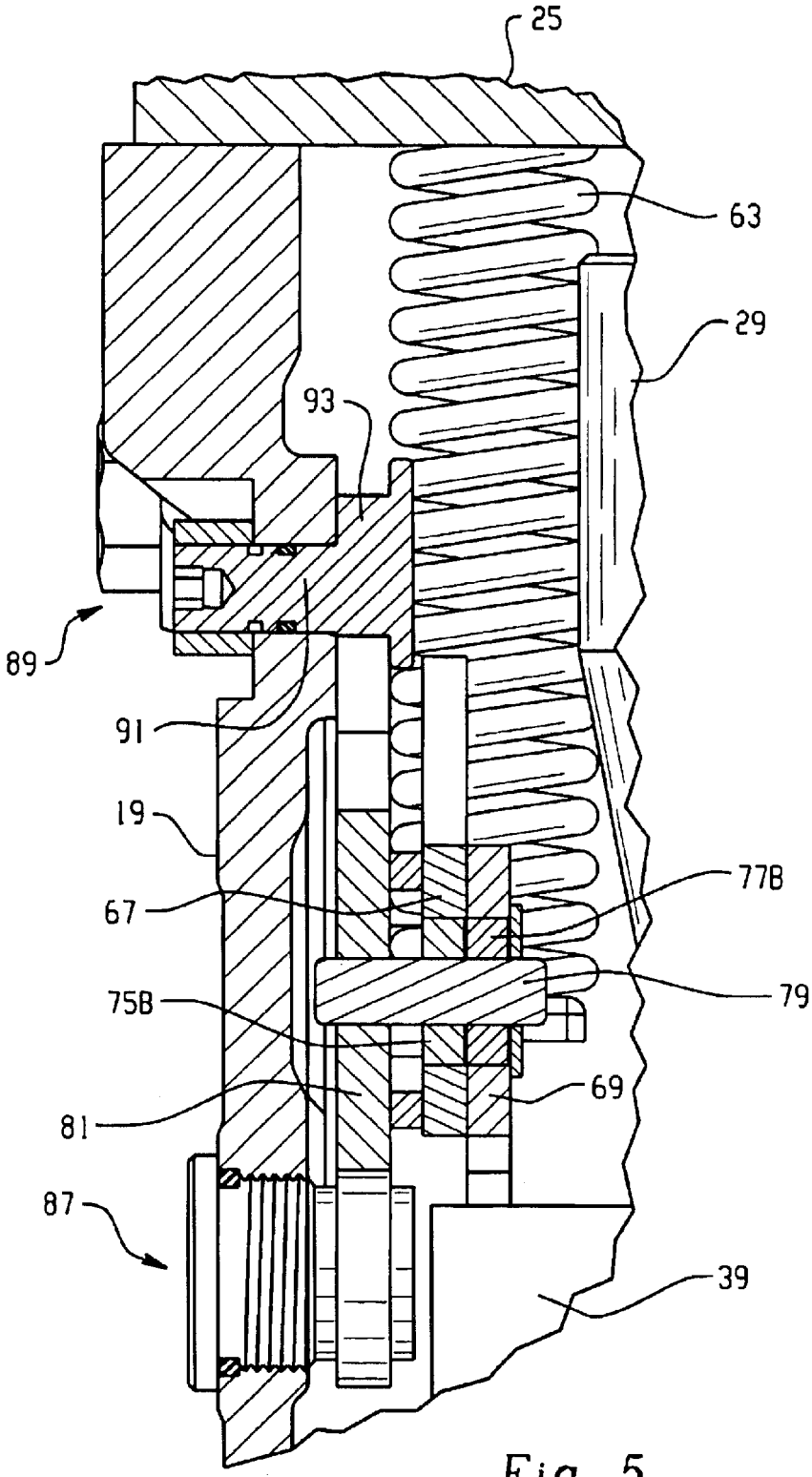
FIG. 5 is an enlarged, fragmentary, axial cross-section, taken on a plane perpendicular to the plane of FIG. 2, and illustrating certain aspects of the centering and holddown mechanism of the present invention, including its relationship to the pump housing.

As may best be seen in FIGS. 3 and 4, the leveling arms 67 and 69 define a pair of elongated slots 75 and 77, respectively, which overlap each other, or "intersect". Extending through the slots 77 and 75, at the overlap therebetween, is a scissor pin 79, which may also be referred to hereinafter, and in the appended claims, as a "connector", because it serves to help connect, or fix the relative positions of, the leveling arms 67 and 69. Preferably, disposed between the elongated slots 75 and 77 and the scissor pin 79 are slider blocks 75B and 77B, respectively (shown only in FIG. 5), which are included primarily for purposes of stress reduction. As was mentioned in the BACKGROUND OF THE DISCLOSURE, it is one advantage of the present invention that tolerances between various associated parts of the mechanism 55 do not have to be held extremely close in order to achieve accurate adjustment of neutral.

The scissor pin 79 is fixed to a guide plate 81 (see also FIG. 6), the guide plate 81 defining a lower U-shaped opening 83 (see FIG. 7) and an upper U-shaped opening 85. It should be noted that references herein to "upper" and "lower" are meant merely to be descriptive with regard to FIGS. 3 through 8, rather than being in any way a limitation of the scope of the invention. Disposed within the lower opening 83 is a pivot pin 87, which is fixed relative to the pump housing 19 (see the lower portion of FIG. 5), such that the lower end of the guide plate 81 pivots about a "fixed" pivot point, i.e., the axis of the pivot pin 87. Disposed within, and adjacent, the upper U-shaped opening 85 is an adjustment assembly, generally designated 89. In the subject embodiment, and by way of example only, the adjustment assembly 89 includes a portion 91, which is rotatably disposed within an opening in the pump housing 19.

Figure 6:
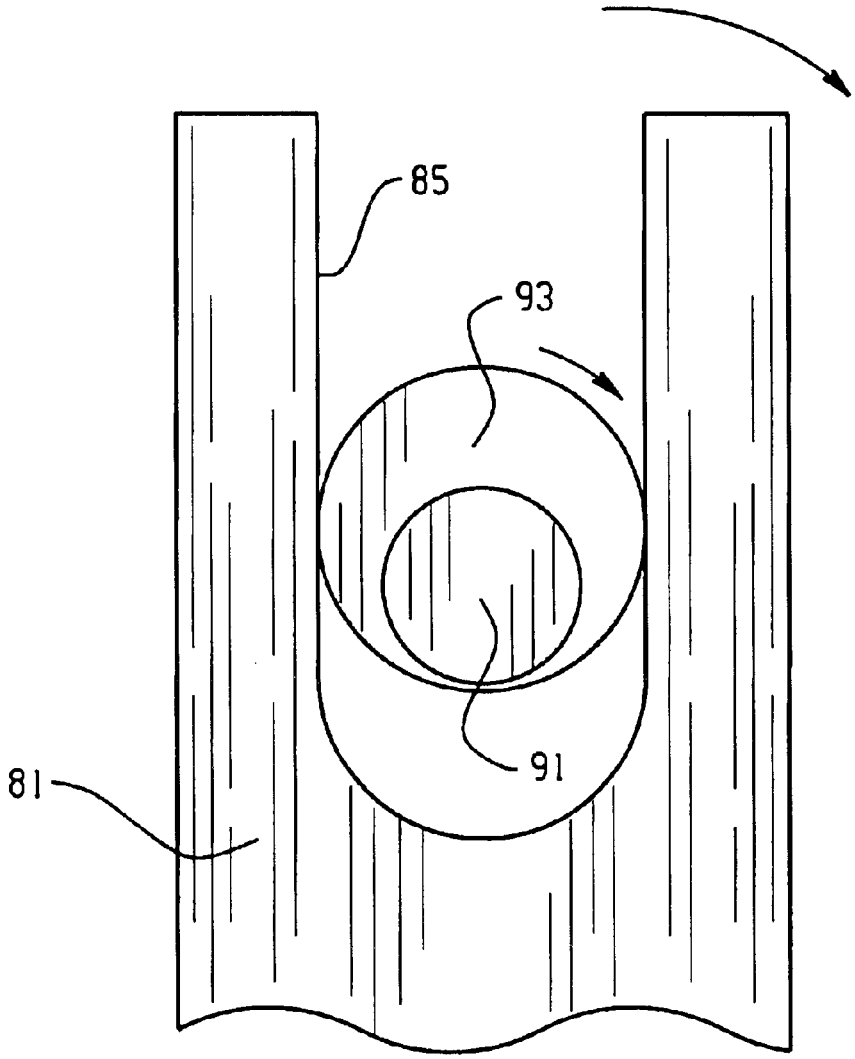
FIG. 6 is a further enlarged, fragmentary, somewhat schematic view, representing a transverse section through the axial cross-section of FIG. 5, and illustrating the adjustment mechanism for the present invention.

The adjustment assembly 89 also includes an eccentric portion 93 (see FIG. 6), fixed to rotate with the portion 91, but mounted eccentrically relative thereto, as is shown schematically in FIG. 6. The eccentric portion 93 is received within the upper U-shaped opening 85, such that rotation of the adjustment assembly 89, for example, in a clockwise direction (as viewed in FIG. 6) will cause the eccentric portion 93 to rotate clockwise (as viewed in FIG. 6), thus causing the guide plate 81 to pivot slightly in a clockwise direction, about the axis of the pivot pin 87. It should be understood that the arrows shown in FIG. 6 are included to facilitate an understanding of the operation of the mechanism, and the lengths thereof are not representative of the magnitudes of movement of either the eccentric portion 93 or of the guide plate 81.

Figure 7:
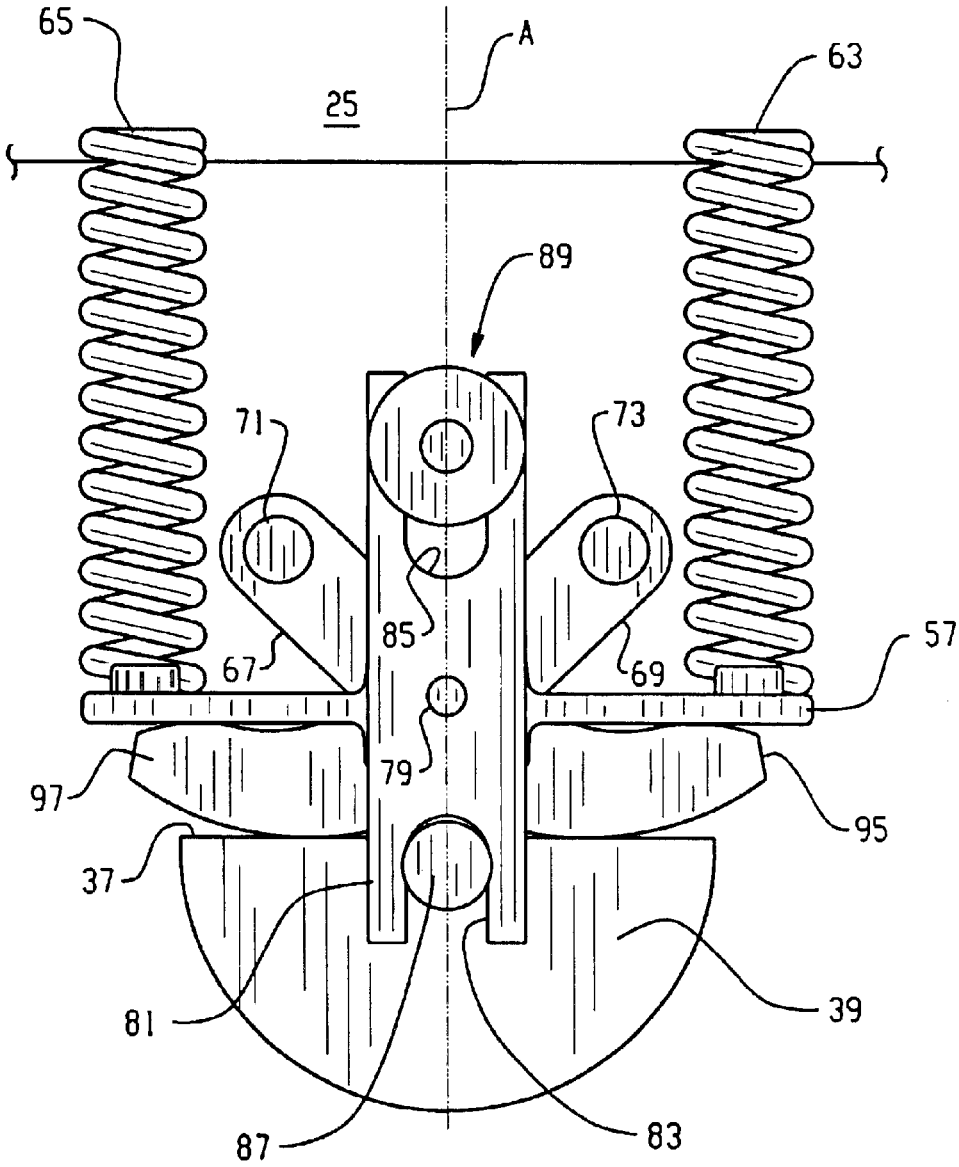
FIGS. 7 and 8 are simplified, somewhat schematic views of the centering and holddown mechanism of the present invention, in its neutral and displaced positions, respectively, viewed in a direction generally opposite that of FIGS. 3 and 4.

Referring again primarily to FIG. 3, in conjunction with FIG. 7, the leveling arm 67 includes a terminal swashplate-engaging portion 95, and similarly, the leveling arm 69 includes a terminal, swashplate-engaging portion 97. Although the portions 95 and 97 have been identified by the term "swashplate-engaging", it should be noted, as may best be seen in FIG. 8, that the terminal swashplate-engaging portions 95 and 97 preferably remain, at all times, in engagement with the spring seat bar 57. More specifically, the portions 95 and 97 remain in engagement with an undersurface of the spring seat bar 57, and even more specifically, and in accordance with the subject embodiment, the portions 95 and 97 remain in engagement with undersurfaces of the spring seats 59 and 61, respectively.

Referring now primarily to FIGS. 3, 4, 7 and 8, it should be noted that the term "scissor" was used previously in reference to the pin 79 which passes through the elongated slots 75 and 77 (and the slider blocks 75B and 77B) of the leveling arms 67 and 69, respectively. As is shown only in FIGS. 3 and 4, the cam member 39 which comprises (or forms) the swashplate 37 defines a central opening 99 through which the input shaft 23 passes, the central opening 99 being large enough, relative to the input shaft 23, to permit the tilting movement of the cam member 39, without making contact with the input shaft 23 or interfering with the rotation of the input shaft 23.

Figure 8:
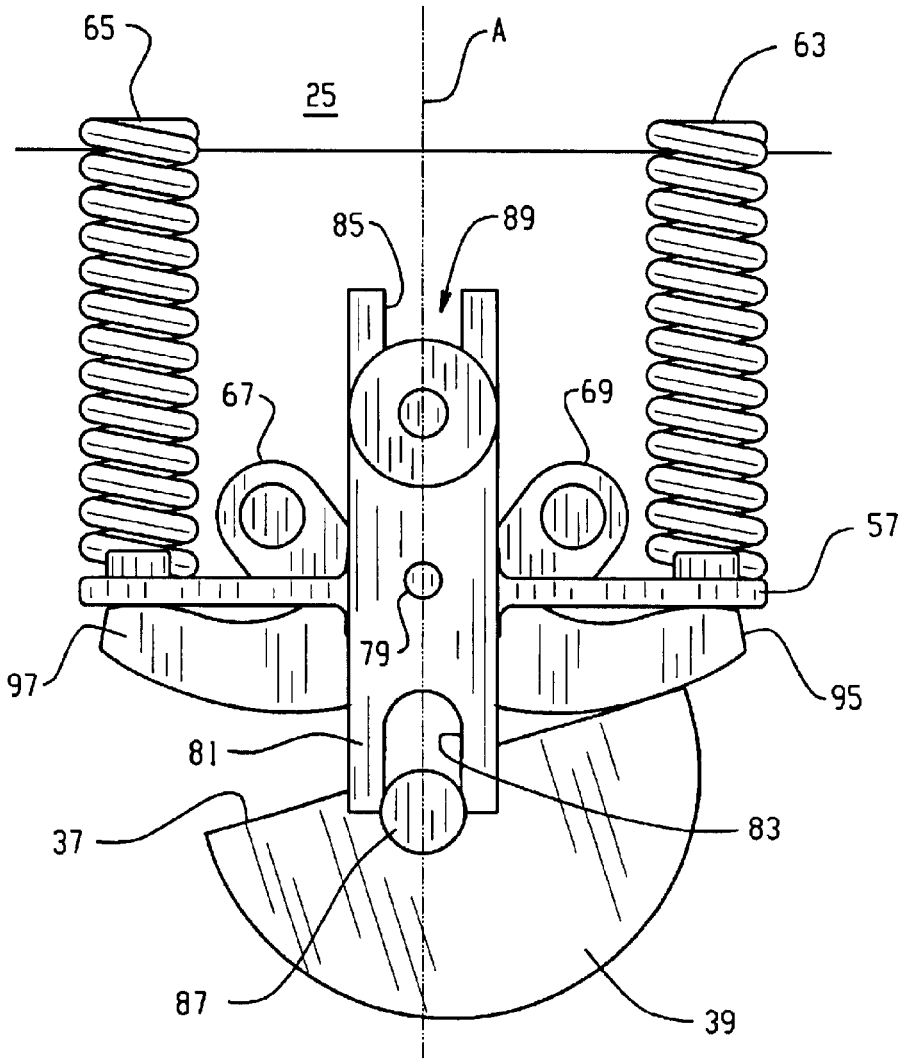

In FIGS. 7 and 8, there is shown a plane which includes the axis of rotation A of input shaft 23, it being understood that the axis of rotation A would coincide with the center of the central opening 99 when the cam member 39 is in its neutral position of FIG. 3. As is best seen in FIGS. 3 and 4, the leveling arms 67 and 69, together with the scissor pin 79, function in a generally "scissors-like" manner, but with certain differences which should be apparent to those skilled in the art from a reading and understanding of this specification. Therefore, the leveling arms 67 and 69 are not fixed, relative to each other, at the axis of the scissor pin 79 (as is a normal pair of scissors), but instead, as was explained previously, each leveling arm pivots, relative to the pump housing 19, about its respective holding pin 71 or 73. However, in accordance with the important aspect of the invention, the "scissor" arrangement of the invention means that the leveling arms 67 and 69 always remain in a symmetrical relationship to each other, about the axis of the scissor pin 79.

By viewing FIGS. 3 and 4 in conjunction with FIGS. 7 and 8, it may be seen that for each leveling arm, there is a pivot location (the holding pin 71 or 73) which is on one side of the axis of rotation A, and the swashplate-engaging portion (95 or 97) of the arm is disposed at the axially opposite end of that particular arm, and on the opposite side of the axis of rotation, relative to the pivot location. Stated another way, the holding pin 71 (associated with the leveling arm 67) and the swashplate-engaging portion 97 of the arm 69 are on one side of the axis of rotation A, while the holding pin 73 (associated with the leveling arm 69) and the swashplate-engaging portion 95 of the arm 67 are on the other side of the axis of rotation A.

When the swashplate 37 is in its neutral position as shown in FIGS. 3 and 7, the compression springs 63 and 65 bias the spring seat bar 57 "downward" (as viewed in both FIGS. 3 and 7), thus biasing both swashplate-engaging portions 95 and 97 into engagement with the swashplate 37, in a manner which ensures absolute neutral (zero displacement) of the cam member 39. In other words, neutral is achieved, in the absence of some sort of input motion to the cam member 39 which would be sufficient to overcome the biasing force of the springs 63 and 65.

Referring now primarily to FIGS. 4 and 8, as an input is provided to the cam member 39, tilting it to its displaced, operating position, the result is that one side or portion of the cam member 39 "rises" (as viewed in FIGS. 4 and 8), biasing the swashplate-engaging portion 95 upwardly, which in turn biases the spring seat bar 57 upwardly. However, in accordance with one important aspect of the invention, and because of the generally scissors-like mode of operation, as the portion 95 is biased upwardly in FIG. 8, pivoting about its holding pin 71, the pivotal movement of the arm 67 moves the scissor pin 79 upward. Such upward movement of the scissor pin 79, in turn, causes the leveling arm 69 to pivot about its holding pin 73. The result is that the swashplate-engaging portion 97 of the arm 69 is in a position, vertically, which corresponds to that of the portion 95, even though the portion 97 has not been forced in an upward direction by the cam member 39 in a manner that the portion 95 has been.

It should be understood that, within the scope of the present invention, the holding pins 71 and 73, which have been illustrated and described herein as being "fixed" relative to the pump housing, must merely be fixed at any given point in time. However, it is within the scope of the invention to make the positions of the holding pins 71 and 73 moveable or adjustable, perhaps as part of the overall adjustability of the mechanism 55. In such a case, the holding pins 71 and 73 would, preferably, be adjusted in a manner which would keep the distance between the axes of the pins 71 and 73 constant, in order to maintain the overall symmetry of the mechanism 55, as was described previously.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

What is claimed is:

1. A swashplate centering and holddown mechanism for a variable displacement axial piston unit comprising a housing defining a chamber, and an axis of rotation, a cylinder barrel disposed for rotation about said axis of rotation, said cylinder barrel defining a plurality of bores and having a plurality of pistons axially moveable therein; a cam member tiltable about a transverse axis, perpendicular to said axis of rotation, and having a swashplate operably associated with each of said pistons to cause reciprocal movement thereof in response to rotation of said cylinder barrel when said cam member is displaced from a neutral position, in which said swashplate is perpendicular to said axis of rotation, to a displaced position; said swashplate centering and holddown mechanism biasing said cam member axially toward a cradle surface and pivotably toward said neutral position; characterized by:

(a) said swashplate centering and holddown mechanism comprising a pair of arms, each of said arms defining a pivot location, at one axial end thereof, fixed relative to said housing on one side of said axis of rotation and a swashplate-engaging portion, at the opposite axial end thereof, engaging said swashplate, on the other side of said axis of rotation, when said swashplate is in said neutral position;

(b) a connector operably associated with said arms, whereby said arms are able to pivot about said pivot locations in a generally scissors-type movement; and (c) biasing means biasing said swashplate-engaging portions of said arms toward said swashplate, whereby, in the absence of an input to tilt said cam member, said swashplate is in engagement with both of said swashplate-engaging portions and is in said neutral position.

2. A swashplate centering and holddown mechanism as claimed in claim 1, characterized by said cradle surface comprises bearing means and said cam member is of the cam-and-cradle type.

3. A swashplate centering and holddown mechanism as claimed in claim 1, characterized by said mechanism is disposed within said chamber defined by said housing, and at one transverse end of said swashplate.

4. A swashplate centering and holddown mechanism as claimed in claim 1, characterized by said biasing means including a spring seat member oriented generally perpendicular to said axis of rotation, said arms being substantially identical, and each of said swashplate-engaging portions of said arms being in engagement with both said swashplate and said spring seat member when said swashplate is in said neutral position.

5. A swashplate centering and holddown mechanism as claimed in claim 4, characterized by each of said swashplate-engaging portions of said arms remaining in engagement with said spring seat member when said swashplate is in said displaced position.

6. A swashplate centering and holddown mechanism as claimed in claim 4, characterized by said spring seat member defining first and second seat portions oppositely and equally disposed relative to said axis of rotation, and said biasing means comprises first and second substantially identical compression springs seated against said first and second seat portions, respectively.

* * * * *